US005224330A

United States Patent [19]

Stahlecker

[11] Patent Number: 5,224,330

[45] Date of Patent: Jul. 6, 1993

[54] ARRANGEMENT FOR THE INTERMEDIATE STORAGE OF A YARN

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany; a part interest

[21] Appl. No.: 829,252

[22] Filed: Feb. 3, 1992

[30] Foreign Application Priority Data

Feb. 16, 1991 [DE] Fed. Rep. of Germany ..... 4104863

[51] Int. Cl.[5] ..... D01H 15/00

[52] U.S. Cl. ..... 57/22; 57/261; 242/47.01; 242/18 R

[58] Field of Search ..... 57/22, 261, 263, 264, 57/328; 242/47.01, 47.12, 18 R

[56] References Cited

U.S. PATENT DOCUMENTS

| | | | |
|---|---|---|---|
| 4,132,056 | 1/1979 | Hüsges et al. | 242/47.12 X |
| 4,553,709 | 11/1985 | Bock et al. | 57/263 X |
| 4,817,880 | 4/1989 | Lenk et al. | 242/18 R X |
| 4,890,800 | 1/1990 | Lenk et al. | 242/18 R X |
| 5,094,377 | 3/1992 | Stahlecker | 57/22 X |

FOREIGN PATENT DOCUMENTS

| | | |
|---|---|---|
| 0108195 | 5/1984 | European Pat. Off. . |
| 3817222 | 11/1989 | Fed. Rep. of Germany . |

*Primary Examiner*—Joseph J. Hail, III

*Attorney, Agent, or Firm*—Evenson, McKeown, Edwards & Lenahan

[57] ABSTRACT

In the case of an arrangement for the intermediate storage of a yarn, a drivable storage roller is provided which helically receives the yarn and to which a yarn transfer device is assigned which has a yarn guiding element deflecting the arriving yarn to the storage roller and which can be moved axially with respect to the storage roller.

22 Claims, 8 Drawing Sheets

ARRANGEMENT FOR THE INTERMEDIATE STORAGE OF A YARN

BACKGROUND AND SUMMARY OF THE INVENTION

This invention relates to an arrangement for the intermediate storage of a yarn, particularly during a repair of a yarn breakage on a spinning arrangement. A drivable storage roller is provided which receives the yarn helically and which is preceded by a continuously yarn-delivering delivery device and followed by a stoppable withdrawal device and which, in the area of its end facing the withdrawal device, is equipped with a yarn driving device which projects into the travelling path of the yarn.

In the case of an arrangement of the initially mentioned type (European Patent Document EP 108 195 B1), the yarn moves onto the storage roller at a predetermined point. This point is formed by a yarn advancing disk which is sloped with respect to the shaft of the storage roller in order to advance the helically wound-up yarn layers in such a manner that space is created for the next yarn layers. In this case, the helical yarn loops slide on the surface of the storage roller in the axial direction. Such a sliding is not acceptable for all types of yarn because it may damage the yarn. This occurs particularly in cases in which yarns having a relatively low strength and/or yarns having a relatively high proportion of synthetic fibers are processed.

It is also known (German Patent Document DE 38 17 222 A1) to provide, in the case of an arrangement for the intermediate storage, a pneumatic yarn storage device in which the yarn is stored in several loops.

It is an object of the invention to develop an arrangement of the initially mentioned type such that a controlled receiving of the helical yarn layers is ensured, in which case sliding movements between the yarn and the surface of the storage roller are avoided.

This object is achieved according to preferred embodiments of the invention in that a yarn transfer device is assigned to the storage roller which has a yarn guiding element deflecting the yarn coming from the delivery device to the storage roller and which can be moved in the axial direction of the storage roller by means of a driving device.

The yarn transfer device provides that the yarn loops are deposited on the storage roller in a regular fashion without being slidingly displaced in the axial direction of the storage roller. In addition, the stored yarn can easily be withdrawn by way of the end of the storage roller.

In a development of the invention, it is provided that the drives of the storage roller and of the yarn transfer device are coupled to one another. This ensures in a simple manner that the helical yarn loops can be deposited at a defined distance with respect to one another.

In an advantageous embodiment of the invention, it is provided that the yarn transfer device has a spindle nut which is arranged on a drivable threaded spindle extending in parallel to the storage roller. In an expedient further development, it is provided that the yarn transfer device is guided on the storage roller. As a result, a securing of the yarn transfer device is obtained with respect to twisting.

In a further development of the invention, it is provided that the yarn driving device of the storage roller can be changed over between an operative state and an inoperative state. The changing-over from the operative to the inoperative state takes place when the storage roller is to be emptied again, which then results in the advantage that the driving device does not impair the emptying. Thus, it is also ensured that no impermissibly high yarn tensions occur during the emptying.

In a further development of the invention, it is provided that the circumferential surface of the storage roller is provided with a helically extending profiling. This profiling provides that the yarn loops are guided separately.

In a further development of the invention, it is provided that, between the storage roller and the withdrawal device, a yarn guiding device is provided which is arranged coaxially with respect to the storage roller and which can be applied to the travelling yarn. As a result, it is ensured that, when the yarn is withdrawn by way of the end of the storage roller, the same withdrawal angle is maintained.

In a further development of the invention, it is provided that a compensating device is provided between the yarn guiding device and the withdrawal device. As a result, the circumstance is taken into account that the yarn withdrawn from the storage roller forms a balloon by means of which the yarn tension is increased.

In a further development of the invention, it is provided that the yarn transfer device is equipped with a yarn detector. This yarn detector emits a signal when the yarn leaves the yarn transfer device and thus also the storage roller; that is, when the yarn storage device is emptied. This signal can then be utilized in such a manner that then the yarn withdrawal speed is reduced from the increased speed used for the emptying of the storage device to the normal withdrawal speed.

Other objects, advantages and novel features of the present invention will become apparent from the following detailed description of the invention when considered in conjunction with the accompanying drawings.

DETAILED DESCRIPTION OF THE DRAWINGS

Figure 1:
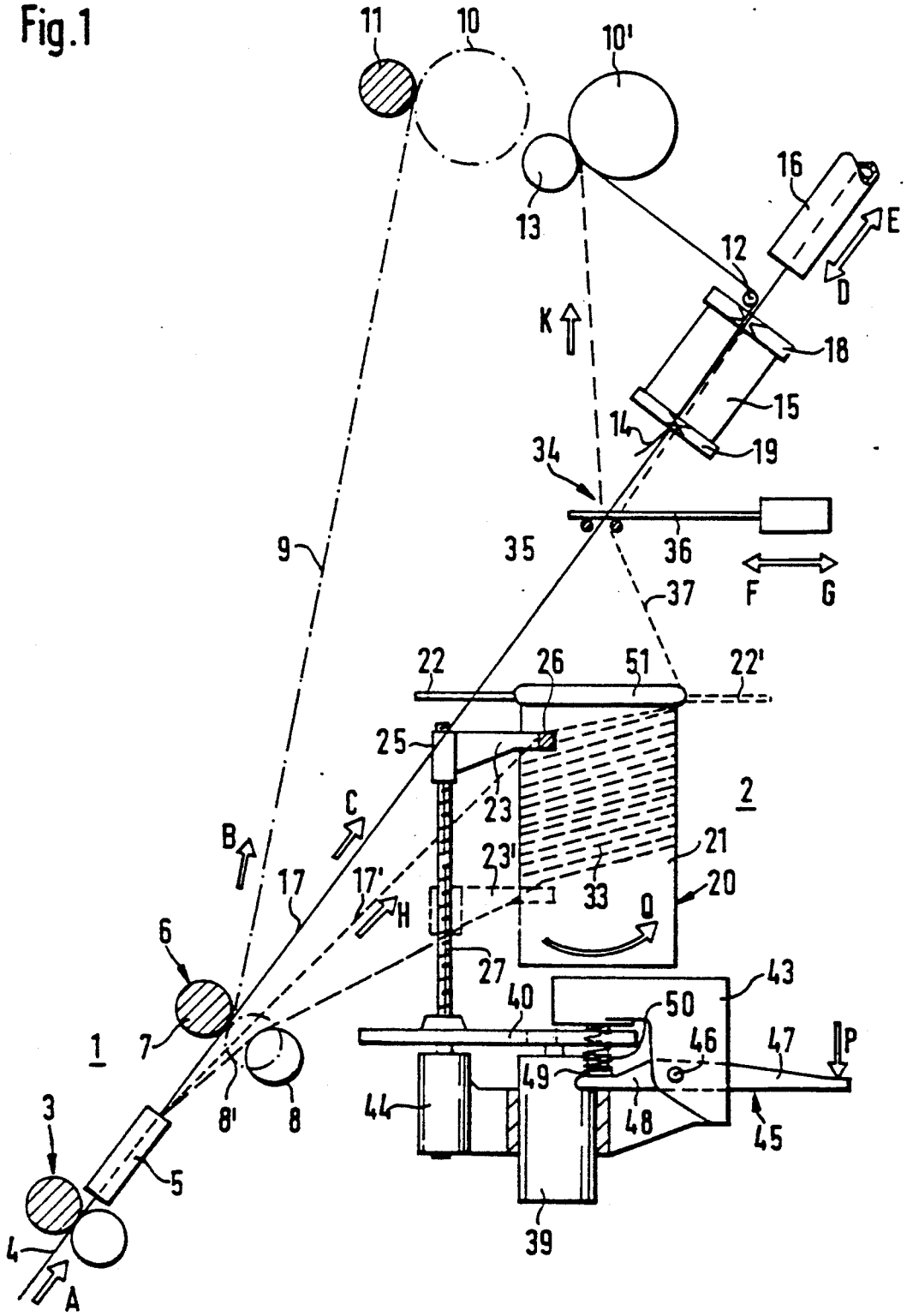
FIG. 1 is a schematic representation of a section of a pneumatic false-twisting arrangement to which a servicing device is applied which is also shown only partially and which comprises an arrangement according to the invention for the intermediate storage of a yarn during the repair of a yarn breakage.

FIG. 1 illustrates a single spinning station 1 of a spinning machine which is provided on at least one side of the machine with a plurality of such spinning stations 1 which are arranged in a row next to one another. The delivery roller pair 3 of a drafting unit of spinning station 1 is shown which delivers a drafted sliver 4 in the direction of the arrow (A) to a pneumatic false-twisting element 5, particularly to a false-twisting nozzle. The false-twist-spun yarn 9 is withdrawn by means of a withdrawal device 6 which is formed of a drivable withdrawal roller 7 and a pressure roller 8. During the normal operation, the pressure roller 8 is situated in position 8'. For the repair of a yarn breakage, it is lifted off the drivable roller 7, as will be explained later. Behind the withdrawal device 6, the yarn 9 is guided to a wind-up spool 10 in the direction of the arrow (B) which is driven by a drivable wind-up roller 11 extending through in the longitudinal direction of the machine. As mentioned above, the spinning station 1 is shown only in a simplified manner; that is, only the elements are shown which are essential for its operation. In addition, the spinning station 1 comprises other devices as they are known on the basis of the state of the art. In particular, these include yarn guides, a cross-winding device and a compensating device.

In the case of a yarn breakage, the delivery of the sliver 4 at the drafting unit is interrupted; that is, no more sliver 4 is fed to the false-twisting element 5 by the delivery rollers 3. A movable servicing device 2 is applied to the respective spinning station 1 which repairs the yarn breakage fully automatically, and restarts the spinning station 1. This movable servicing apparatus 2, with the exception of the device for storing a yarn which is part of it, is shown only schematically because the other elements are known on the basis of the state of the art.

During the repair of the yarn breakage, the wind-up package 10' is lifted off the winding roller 11. Here, an auxiliary winding roller 13 of the servicing device 2 is applied. In a known manner, the auxiliary winding roller 13 is provided with a drive which can be switched to both rotating directions and which is first switched to the wind-off direction. A yarn searching nozzle is assigned to the wind-up package 10' which is not shown, which receives the broken yarn end 14 and which places the yarn withdrawn from the wind-up package 10' into a known pneumatic splicing device 15. The splicing device 15 is equipped with yarn clamping devices and yarn cutting devices which have the reference numbers 18 and The servicing device 2 is equipped with devices, which are not shown, and which restart the spinning station 1 such that the delivery roller pair 3 of the drafting unit again delivers the sliver 4 to the false-twisting element 5. A suction nozzle 16 is applied in the direction of the arrow (D) to the false-twisting element 5 and receives the newly spun yarn 17 and then moves back into the direction of the arrow (E) so that the newly spun yarn 17 is withdrawn in the direction of the arrow (C) and is placed in the splicing device 15. The withdrawal device 6 is opened in that the pressure roller 8 is lifted off the drivable roller by devices of the servicing device 2 which are not shown. The spun yarn 17 travels through the splicing device 15 and is sucked off by the suction nozzle 16. A yarn guiding device 34 of the servicing device 2 is applied to the travelling yarn 17 which is formed of two fork-shaped yarn guides 35, 36 which together form the yarn guiding device 34. As shown for the fork-shaped yarn guide 36 by means of the arrows (F and G), the two yarn guides 35, 36 can be advanced and pulled back.

The yarn guiding device 34 is arranged coaxially with respect to a storage roller 21 of a yarn storage device 20 of the servicing device 2. During the establishment of the spliced yarn connection in the splicing device 15, the newly spun yarn 17 is stopped for a short time so that the spliced connection can be prepared and established. Since the delivery of the yarn 17 cannot be interrupted, the yarn 17 is intermediately stored during this time on the storage device 20. After the establishment of the spliced connection, the splicing device 15 releases the yarn 17, after which a yarn guide 12 moves in the direction of the auxiliary winding roller 13, whereby a yarn loop is opened up which exists between the yarn guiding device 34 and the auxiliary winding roller 13. In this case, the auxiliary winding roller 13 is driven in the wind-up direction at a winding speed which is increased in comparison to the operating speed.

Figure 2:
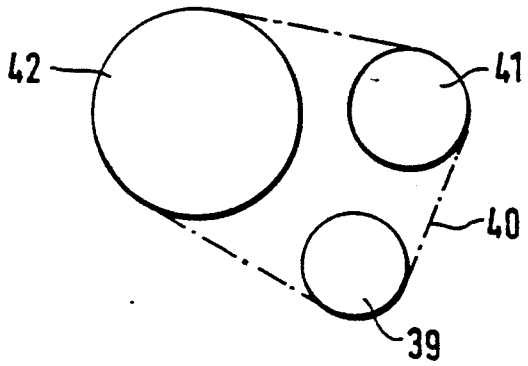
FIG. 2 is a schematic representation for the drive of the storage roller of FIG. 1 and of a pertaining yarn transfer device.

As mentioned above, during the establishment of the spliced connection, the continuously delivered yarn 17 is transferred into a position 17' and is intermediately stored by the yarn storage device 20. For this purpose, the yarn 17' is wound in the form of helices 33 onto the storage roller 21 which is driven in the direction of the arrow (Q). In the area of its end 51 which faces the auxiliary winding roller 13 serving as the withdrawal device, the storage roller 21 is equipped with a yarn driving device 22 which projects into the travelling path of the yarn 17. The drive of the storage roller 21 is already switched on shortly before the point in time at which the splicing device 15 interrupts the withdrawal o the yarn 17 toward the suction nozzle 16 by closing its clamp. The intermediate storage of the yarn 17' begins already at this point in time. The yarn driving device 22 deflects the travelling yarn 17 such that it is placed into a V-shaped guiding element 26 of a yarn transfer device 23 which controls the depositing of the helices 33 on the storage roller 21. By means of a spindle nut 25, the yarn transfer device 23 is mounted on a drivable threaded spindle 27 which is arranged at a distance next to the storage roller 21 and in parallel to its axis. In a supporting part 43 of the servicing device 2, a bearing housing for the storage roller 21 as well as a bearing housing 44 for the threaded spindle 27 are arranged. In addition, a joint driving motor 39 is also disposed in this bearing part 43 which drives the storage roller 21 and the threaded spindle 27 by way of a synchronous belt drive 40, as it is shown in FIG. 2. The electric driving motor 39 is provided with a synchronous belt disk which, by way of a synchronous belt 40, drives a synchronous belt disk 41 of the storage disk 21 and, by way of another synchronous belt disk 42, drives the threaded spindle 27. The joint drive has the advantage that an exact coordination is obtained between the rotational speed of the storage roller 21 and the axial movement of the yarn transfer device 23 without the requirement of a control. The transmission is selected to be such that helices 33 are created which are disposed next to one another at a sufficient distance. As illustrated in FIG. 1, the yarn transfer device 23 is first situated in a starting position in the area of the upper end 21 of the storage roller 21 from which it moves to the opposite end. An intermediate position 23' is shown in FIG. 1.

As mentioned above, the storage roller 21 is already set into rotation before the splicing device 15 is actuated and the yarn 17 is stopped in the splicing device 15. Thus, the first helices 33 are formed on the storage roller 21 before the actual splicing operation. The yarn piece, which rotates between the yarn driving device 22 and the yarn guiding device 34 thus receives a false twist which has the effect of a protective twist and protects also a sensitive yarn, which has only a weak strength, from damage. As soon as the withdrawal starts for the emptying of the yarn storage device 20, the yarn driving device 22 is placed in an inoperative position, a will be explained in detail later by means of FIGS. 4 to 6. However, during the withdrawal for the emptying of the yarn storage device 20, the yarn 17' continues to move onto the storage roller 21. In the case of a yarn delivery of 5 m/s and taking into account the splicing time, the previously already carried-out starting of the storage roller 21 and the emptying time, for example, a total length of 25 m yarn 17' is obtained which must be intermediately stored in helices. When the diameter of the storage roller 21 amounts to 100 mm, approximately 314 mm are obtained per helix 33. On the whole, therefore, approximately 80 helices 33 must be expected. When the distance between the helices 33 amounts, for example, to 1.5 mm, a working length of 120 mm is obtained for the storage roller 21. In order to comply with the yarn delivery of 5 m/s, the storage roller 21 must run at approximately 9,200 $min^{-1}$, in which case, for reasons that will be explained in the following, a negative draft is taken into account. Such rotational speeds can be implemented by means of small-size motors which are commercially available nowadays.

During the normal operation, a negative draft is used in pneumatic false-twist spinning; i.e., the withdrawal device 6 has a slightly lower speed than the pair of delivery rollers 3 of the preceding drafting unit. As a result, the yarn 9 is permitted to form a small balloon inside the false-twisting element 5 which ensures the development of a sufficient false twist. If, during the repair of the yarn breakage, the yarn 17' were to be delivered by the withdrawal device 6 to the storage roller 21, the storage roller 21 would have to have a circumferential speed which corresponds to precisely the delivery speed of the withdrawal device 6. In order to be able to do without such a precise speed coordination, the withdrawal device 6 is stopped during the repair of the yarn breakage. The circumferential speed of the storage roller 21 will then be coordinated with the delivery speed of the delivery rollers 3 while taking into account a negative draft. Minor deviations of these speeds are less critical because they are absorbed by the yarn balloon forming inside the false-twisting element 5.

Figure 3:
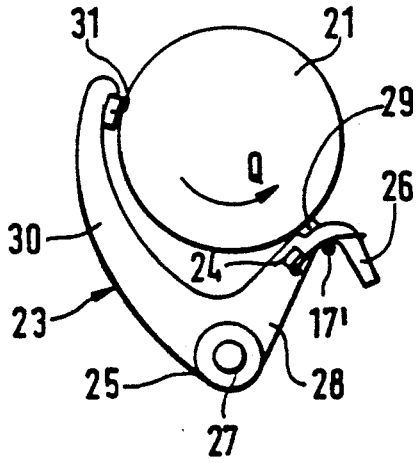
FIG. 3 is an axial view of the storage roller with the yarn transfer device guided on it.

During the emptying of the yarn storage device 20, the package 10' is driven by the auxiliary winding roller 13 at an increased speed. After the stored yarn length has been used up, the winding speed is reduced to the operative winding speed; that is, to the speed of the winding roller 11. The package 10' is then transferred to the winding roller 11 so that it resumes its operative position 10. In order to detect the point in time when the yarn storage device 20 is empty, a corresponding yarn detector 24 is mounted either on the storage roller 21 or on the yarn transfer device 23. A yarn detector 24 of this type is illustrated in FIG. 3 This yarn detector 24 comprises a microswitch which has a yarn sensor situated in the area of the V-shaped guiding element 26. As soon as the yarn 17' leaves the yarn guiding element 26, the yarn detector 24 will emit a corresponding signal which is utilized in the control of the servicing device 2 such that the auxiliary winding roller 13 is reduced to the operative speed with a certain time delay.

As indicated in FIG. 3, the yarn transfer device 23 has two arms 28, 30 which are arranged in a V-shape with respect to one another and the ends of which rest by means of sliders 29, 31 against the circumference of the storage roller 21. As a result, it is ensured that the yarn transfer device 23 is secured against a twisting on the threaded spindle 27.

After the yarn storage device 20 has been emptied, the drive of the storage roller 21 and of the threaded spindle 27 is reversed so that the yarn transfer device 23 is returned into its starting position. By means of a pertaining control the driving motor 39 is stopped in such a manner that the yarn storage device 21 and the yarn transfer device 23 come to a stop in a predetermined position; that is, in the position in which the yarn driving device 22 is arranged such that it can grip the travelling yarn 17 after covering only a short path.

Figure 4:
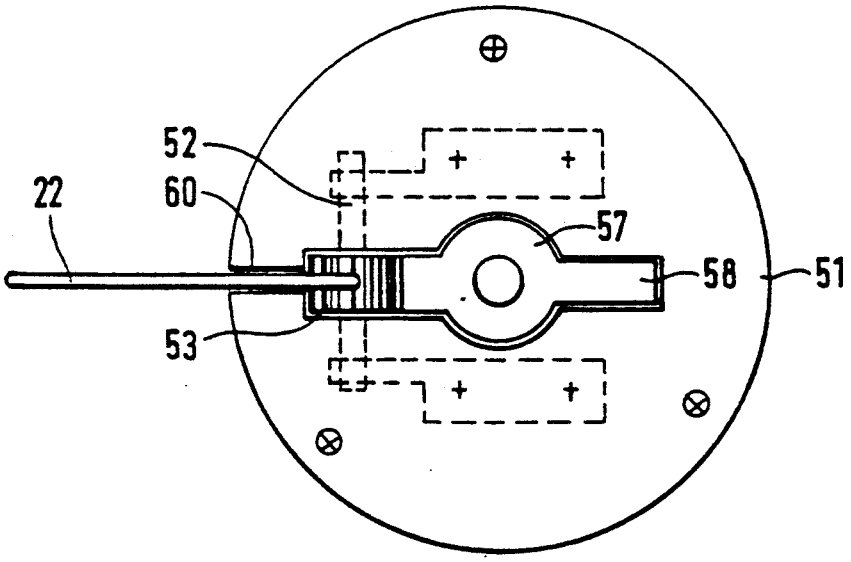
FIGS. 4 to 6 are partial views and partial sectional views of a storage roller with a yarn driving device which can be changed over between an operative position and in inoperative position.
Figure 5:
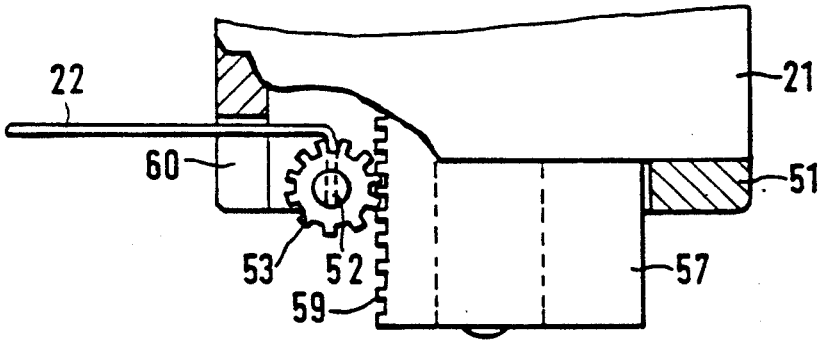
Figure 6:
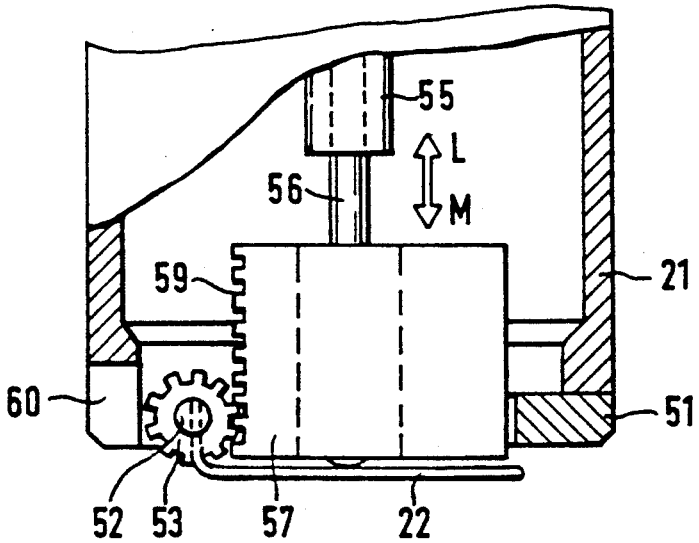

As mentioned above, the yarn driving device 22 is brought into an inoperative position immediately before the start of the withdrawal for the emptying of the storage roller 21. The yarn driving device 22 is disposed in the lid-type end 51 of the storage roller 21 so that it can be swivelled about a transverse shaft 52 (FIG. 4 to 6). In the operative position, it projects through a slot 60 to the outside. The shaft 52 is non-rotatably provided with a pinion 53 which is engaged in a rack-type toothing 59 of an adjusting element 57 which is slidable in the axial direction inside the storage roller 21. The adjusting element 57, which is secured against twisting by means of a projection 58 guided in a slot guide, is connected with a tappet 56 which penetrates a hollow shaft 55 of the storage roller 21 and can be adjusted in the direction of the arrows (L and M) in the axial direction to the storage roller 21. The tappet 56 projects in the axial direction out of the bearing housing of the storage roller 21 and is supported on a thrust piece 49 of an arm 48 of an adjusting lever 45 which can be swivelled about a transverse shaft 46 and the other lever arm 47 of which can be adjusted by way of an adjusting element of the servicing device 2 which is indicated by an arrow (P) (FIG. 1). By means of a pressure spring 50, the adjusting lever 45 is held in the position in which the yarn driving device 22 is in the inoperative position (FIG. 6). By means of the swivelling of the actuating lever 45 in the direction of the arrow (P), the yarn driving device 22 is moved out into the operative position (FIG. 1, 4, and 5).

Figure 7:
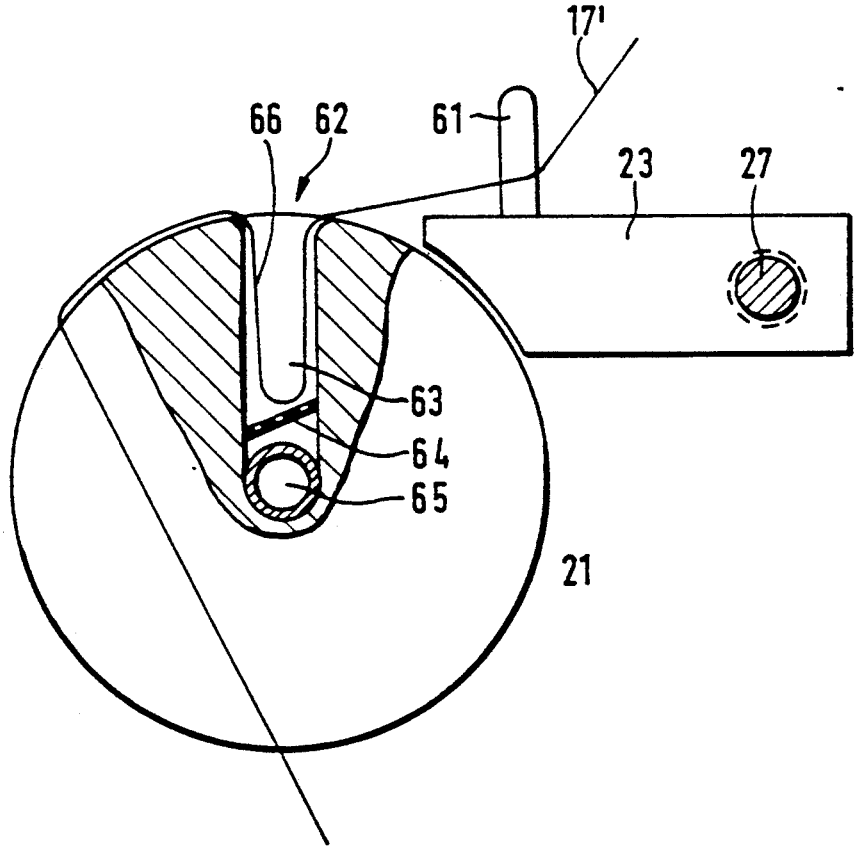
FIGS. 7 to 10 are schematic views of further embodiments of yarn driving devices for a storage rollers which can be changed over.

FIG. 7 illustrates a switchable yarn driving device 62 for a storage roller 21 which does not require any movable elements. In the area of its upper end, the storage roller 21 is provided with a recess 63 which is open in the direction of its circumference and which, by way of a sieve 64, is connected to a central suction pipe 65 of the storage roller 21. When suction air is admitted, the yarn 17' is taken in as a yarn loop 66 so that the yarn 17' is taken along sufficiently securely by the storage roller 21. As soon as the suction pressure has ceased and/or is replaced by a compressed-air flow, the operation of the yarn driving device 62 is terminated so that then the withdrawal can take place for the emptying of the yarn storage device.

In the embodiment according to FIG. 7, the yarn transfer device 23 is provided with a smooth pin serving as the yarn guiding element 61.

In the below described embodiments of FIGS. 8–12, corresponding reference numbers with letter suffices A, B, C, D, are provided in the drawings for parts corresponding generally to similar numbered parts of the embodiment of FIGS. 1–7. Only the different features of these embodiments of FIGS. 8–12 as compared to FIGS. 1–7 are described, and reference may be made to the above description of FIGS. 1–7 for a description of the remaining structures.

Figure 8:
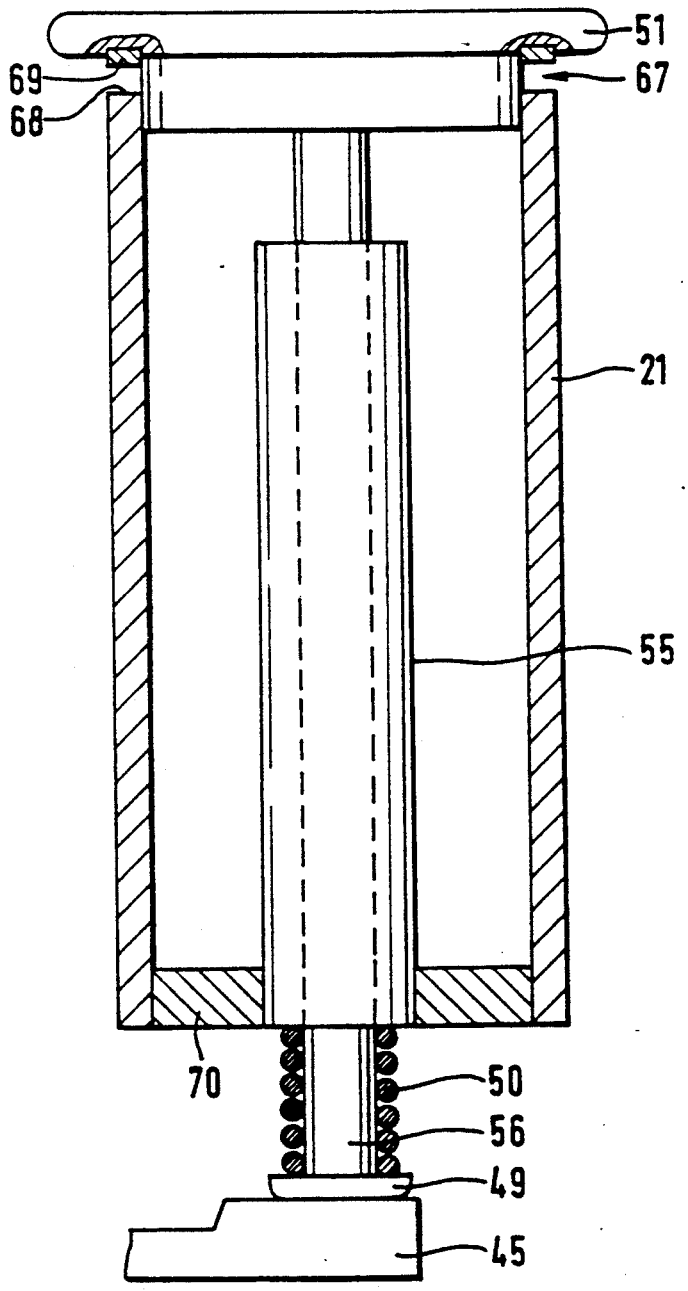

In the embodiment according to FIG. 8, a switchable yarn driving device is created in that the lid-type end 51A of the storage roller 21A is slidable in the axial direction relative to the pertaining front face 68 of the storage roller 21A. By means of the adjusting device, which was explained by means of FIGS. 1, 4, 5 and 6, the lid-type end 51A can be displaced. The lid-type end 51A is provided with a clamping ring 69 which faces the front end 68 of the storage roller 21A and which, between itself and the front face 68, forms a yarn driving device 67 in the form of a clamp.

The embodiment according to FIG. 8 shows very clearly that the lid-type end 51A has a larger diameter than the storage roller 21A and is provided with a rounded edge. As a result, the individual helices 33 are lifted securely off the shell surface when the storage roller 21A is emptied. This type of an edge, which juts out radially toward the outside, is particularly advantageous when the shell surface of the storage roller 21A is provided with a helically extending profiling because then the lifting-out of the individual helices 33 is ensured with higher reliability. The profiling has the advantage that the individual helical loops of the yarn are securely separated from one another while, at the same time, a relatively small axial distance may be permitted.

Figure 9:
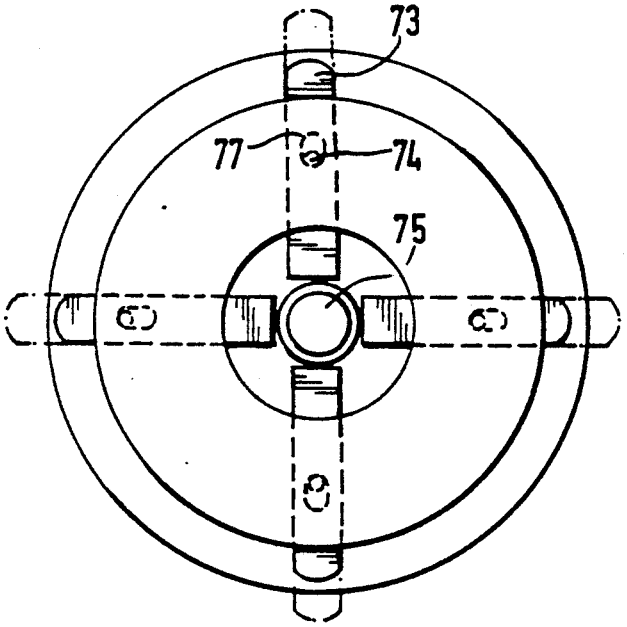
Figure 10:
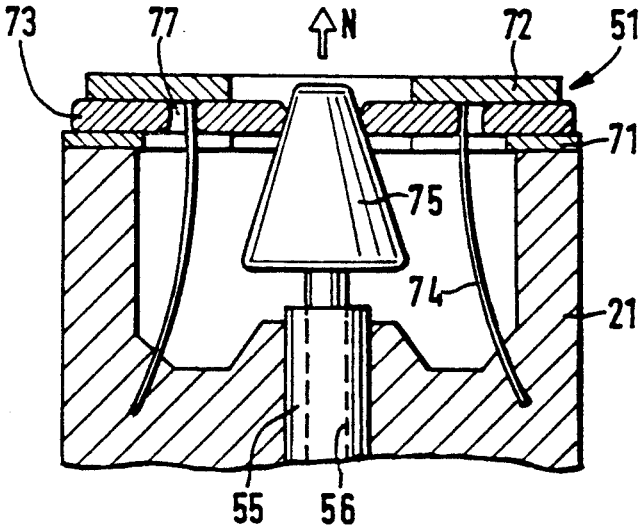

Another embodiment of switchable yarn driving devices is illustrated in FIGS. 9 and 10 in which case this storage roller 21B, in the area of its upper end 51B, is provided with four finger-type yarn driving devices 73 which are uniformly distributed along the circumference and can be moved out into the radial direction. The finger-type yarn driving devices 73 are guided in radial recesses 77 between two plates 71, 72 forming a lid for the storage roller 21B. Spring yokes 74, which are designed such that they pull the yarn driving devices 73 radially toward the inside, engage in these recesses 77 of the yarn driving devices 73. The inner ends of the yarn driving devices 73 rest against a cone 75 which can be adjusted in the axial direction of the storage roller 21B and which can be displaced by way of a tappet 56B in the direction of the arrow (N) and against this direction and which is guided in a hollow shaft 55B of the storage roller 21B.

Figure 11:
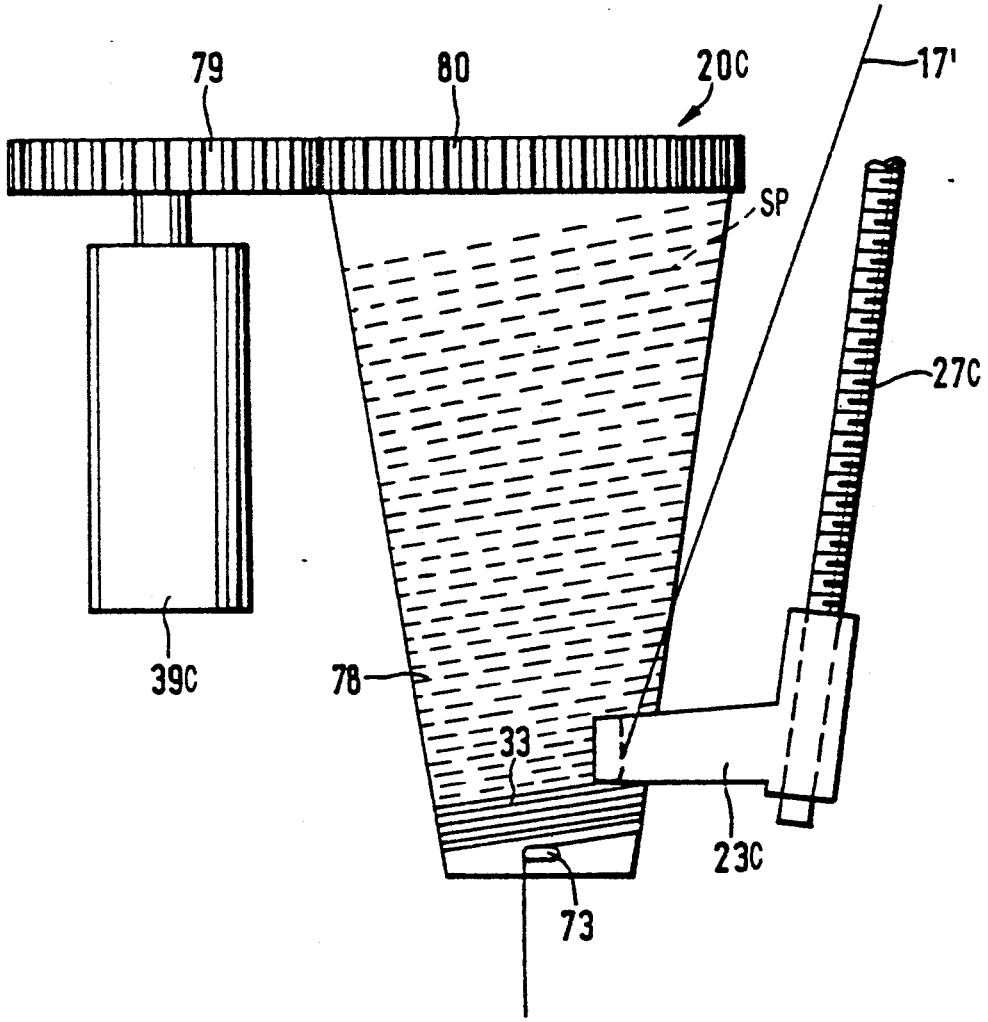
FIG. 11 is a schematic view of truncated-cone-shaped storage roller with its drive.

FIG. 11 illustrates an embodiment for a yarn storage device 20C which is provided with a truncated-cone-shaped storage roller 78. Such a truncated-cone-shaped storage roller 78 facilitates the axial withdrawal. It is expedient, in the case of such a truncated-cone-shaped storage roller 78, for a surface profiling SP to be provided in the form of threaded grooves or the like, in which the helices 33 of the yarn 17′ are deposited. The threaded spindle 27C, which carries the yarn transfer device 23C, in this embodiment, is arranged in parallel to a generating line of the storage roller 78.

In the embodiment according to FIG. 11, the storage roller 78 is driven by way of two toothed wheels 79, 80 directly by an electric motor 39C. The drive of the threaded spindle 27C, which is derived from the same electric motor 39C, is not shown. The electric motor 39C is controlled in such a manner that, despite the truncated-cone shape of the storage roller 78, a constant speed is obtained at which the helices 33 of the yarn 17′, which is delivered at a constant speed, are wound.

Figure 12:
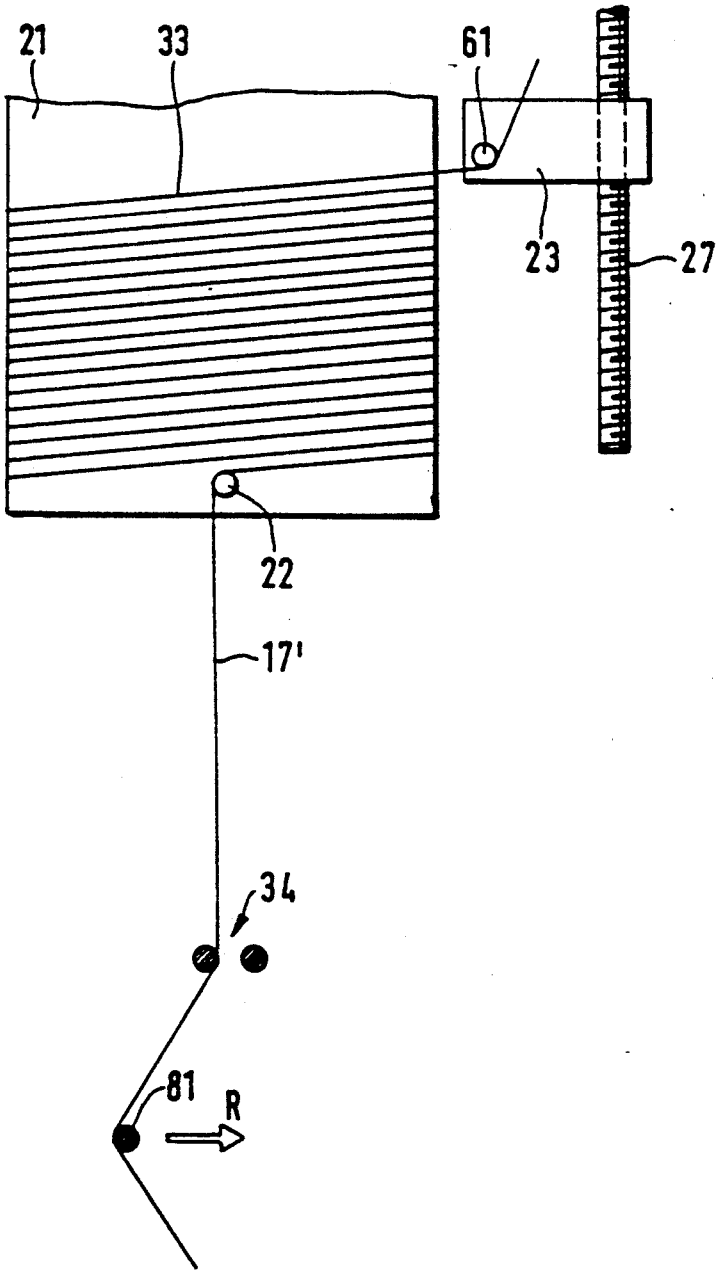
FIG. 12 is a partial view of an arrangement according to the invention in which a compensating device is connected behind the storage roller.

As shown in FIG. 12, the yarn guiding device 34, which is arrange centrically with respect to the storage roller 21D, is followed by a yarn compensating device 81 by which shortenings of the yarn and/or yarn tensions are compensated during the emptying of the storage device. In the simplest embodiment, this yarn compensating device 81 consists of a spring yoke 81 which is elastically flexible transversely to the yarn travel in the direction of the arrow (R). However, it is also within the scope of the invention to provide a yarn guide 81 here which, by way of a transmission or the like, carries out a controlled compensating movement.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Intermediate yarn storage apparatus for accommodating yarn storage during repair of a yarn breakage at a spinning unit having a spun yarn supply device for supplying spun yarn to a primary yarn storage device with yarn travelling along a yarn travel path between the spun yarn supply device and the primary yarn storage device during spinning operations, said intermediate storage apparatus comprising:

a drivable storage roller for storing yarn in helixes thereon as the yarn is supplied by the spun yarn supply device, a yarn transfer device assigned to the storage roller, said yarn transfer device having a yarn guiding element for deflecting yarn supplied by the supply device to the storage roller, and a yarn transfer device drive unit for driving the yarn transfer device to move axially of the storage roller, to control storage of the yarn on the storage roller.

2. Intermediate yarn storage apparatus according to claim 1, comprising a yarn driving device carried by the storage roller for controlling movement of the yarn from the yarn travel path to the storage roller.

3. Intermediate yarn storage apparatus according to claim 2, wherein said yarn transfer device drive unit includes apparatus for moving the yarn transfer device from an initial position adjacent an end of the storage roller facing the primary yarn storage device toward a final position adjacent an opposite end of the storage roller.

4. Intermediate yarn storage apparatus according to claim 3, comprising a storage roller drive unit for rotatably driving the storage roller.

5. Intermediate yarn storage apparatus according to claim 4, comprising coupling apparatus coupling the storage roller drive unit and the yarn transfer device drive unit.

6. Intermediate yarn storage apparatus according to claim 4, wherein the yarn transfer device drive unit includes a spindle nut which is arranged on a drivable threaded spindle which extends in parallel to the storage roller.

7. Intermediate yarn storage apparatus according to claim 4, wherein a yarn guiding device is provided between the storage roller and the primary yarn storage device, said yarn guiding device being arranged coaxially with respect to the storage roller and being engageable with the travelling yarn.

8. Intermediate yarn storage apparatus according to claim 7, wherein the yarn transfer device is provided with a yarn detector.

9. Intermediate yarn storage apparatus according to claim 8, wherein a compensating device is provided between the yarn guiding device and the primary yarn storage device.

10. Intermediate yarn storage apparatus according to claim 2, wherein the yarn driving device of the storage roller can be changed over between an operative state in the yarn travel path and an inoperative state out of the yarn travel path.

11. Intermediate yarn storage apparatus according to claim 1, wherein said yarn transfer device drive unit includes apparatus for moving the yarn transfer device from an initial position adjacent an end of the storage roller facing the primary yarn storage device toward a final position adjacent an opposite end of the storage roller.

12. Intermediate yarn storage apparatus according to claim 1, comprising a storage roller drive unit for rotatably driving the storage roller.

13. Intermediate yarn storage apparatus according to claim 1, wherein the yarn transfer device drive unit includes a spindle nut which is arranged on a drivable threaded spindle which extends in parallel to the storage roller.

14. Intermediate yarn storage apparatus according to claim 1, wherein the storage roller is provided with a helically extending profiling on its circumferential surface.

15. Intermediate yarn storage apparatus according to claim 1, wherein the storage roller has a cylindrical shape.

16. Intermediate yarn storage apparatus according to claim 1, wherein the storage roller has a truncated-cone-shaped form, the smaller diameter of which faces the primary yarn storage device.

17. Intermediate yarn storage apparatus according to claim 1, wherein a yarn guiding device is provided between the storage roller and the primary yarn storage device, said yarn guiding device being arranged coaxially with respect to the storage roller and being engageable with the travelling yarn.

18. Intermediate yarn storage apparatus according to claim 1, wherein a compensating device is provided between the yarn guiding device and the primary yarn storage device.

19. Intermediate yarn storage apparatus according to claim 1, wherein the yarn transfer device is provided with a yarn detector.

20. Intermediate yarn storage apparatus according to claim 1, wherein said storage apparatus is carried on a movable servicing carriage that can be selectively moved to servicing positions adjacent respective ones of a plurality of commonly driven spinning units.

21. Intermediate yarn storage apparatus according to claim 1, comprising a guide for movably guiding the yarn transfer device along the length of the storage roller.

22. Intermediate yarn storage apparatus according to claim 1, wherein said primary yarn storage device is a wind-up spool.

* * * * *